US010688348B2

(12) United States Patent
Wright

(10) Patent No.: US 10,688,348 B2
(45) Date of Patent: Jun. 23, 2020

(54) METHODS AND SYSTEMS ASSOCIATED WITH AN OBJECT FOR A GAME

(71) Applicant: Chris Wright, Spring, TX (US)

(72) Inventor: Chris Wright, Spring, TX (US)

( * ) Notice: Subject to any disclaimer, the term of this patent is extended or adjusted under 35 U.S.C. 154(b) by 0 days.

(21) Appl. No.: 16/377,850

(22) Filed: Apr. 8, 2019

(65) Prior Publication Data

US 2020/0038716 A1 Feb. 6, 2020

Related U.S. Application Data

(60) Provisional application No. 62/714,117, filed on Aug. 3, 2018.

(51) Int. Cl.
*A63B 43/00* (2006.01)
*A63B 71/06* (2006.01)

(52) U.S. Cl.
CPC ..... *A63B 43/002* (2013.01); *A63B 71/06* (2013.01); *A63B 2243/007* (2013.01)

(58) Field of Classification Search
CPC . A63B 43/002; A63B 71/06; A63B 2243/007; A63B 65/10; A63H 33/18; A45C 1/12
USPC ..... 473/594, 595; D99/34, 37
See application file for complete search history.

(56) References Cited

U.S. PATENT DOCUMENTS 2,529,024 A 11/1950 Jones
2,860,768 A * 11/1958 Smithers ..... B65D 81/1075 206/523
3,080,963 A * 3/1963 Rothgart ..... B60R 7/087 206/0.84
3,138,244 A * 6/1964 White ..... B60R 7/08 206/0.81
3,819,039 A * 6/1974 Erickson ..... A61B 17/06061 206/388
4,003,574 A * 1/1977 MacDonald ..... A63B 39/00 473/613
D287,988 S * 1/1987 Billinghurst ..... D21/468
5,158,284 A * 10/1992 Vogl ..... A63B 43/00 273/DIG. 20
5,228,687 A * 7/1993 Luecke ..... A63B 43/00 273/DIG. 20
5,383,660 A * 1/1995 Adler ..... A63B 43/002 273/DIG. 20
5,676,611 A * 10/1997 Foster ..... A63B 43/002 473/596
5,766,104 A * 6/1998 Albarelli, Jr. ..... A63B 43/00 473/567
5,807,198 A * 9/1998 Grimm ..... A63B 65/00 473/613
6,149,955 A 11/2000 Wilson
6,470,830 B2 10/2002 Mann
6,746,351 B1 * 6/2004 Goodman ..... A63B 39/00 473/596
D522,710 S * 6/2006 Beacham ..... D99/37
(Continued)

*Primary Examiner* — Steven B Wong
(74) *Attorney, Agent, or Firm* — Pierson Intellectual Property LLC

(57) ABSTRACT

Embodiments of this disclosure are related to methods and systems associated with a game. The gaming system may be configured to allow a thrower to throw an object, and store tokens associated with the game within the object. This may allow for players of the game to readily and efficiently tabulate the score of a game. Embodiments may include a throwing object and tokens.

12 Claims, 13 Drawing Sheets

(56) References Cited

U.S. PATENT DOCUMENTS

| | | | | |
|---|---|---|---|---|
| 7,367,283 | B2 * | 5/2008 | Aboujaoude | A01K 15/025 119/702 |
| D580,112 | S * | 11/2008 | Stiles | D21/713 |
| D583,519 | S * | 12/2008 | Roberts | D32/29.1 |
| 7,600,488 | B2 | 10/2009 | Mann | |
| 7,914,405 | B1 * | 3/2011 | Scheffler | A01K 15/026 119/707 |
| D658,243 | S * | 4/2012 | Saber | D21/707 |
| 8,162,156 | B1 * | 4/2012 | Crisman | G10D 13/003 211/10 |
| 8,215,479 | B2 | 7/2012 | Willms et al. | |
| D668,007 | S * | 9/2012 | Ottosson | D21/460 |
| D748,871 | S * | 2/2016 | Setser | D30/160 |
| D755,450 | S * | 5/2016 | Setser | D30/160 |
| D760,092 | S * | 6/2016 | Goldman | D21/483 |
| 9,492,737 | B2 | 11/2016 | Yu et al. | |
| 9,661,829 | B2 * | 5/2017 | Sternal | A01K 15/027 |
| D793,500 | S * | 8/2017 | Dingle | D21/712 |
| 2006/0217220 | A1 * | 9/2006 | Davignon, II | A63B 43/002 473/613 |
| 2007/0155549 | A1 * | 7/2007 | Keker | A63B 37/14 473/613 |
| 2008/0220915 | A1 * | 9/2008 | Frazier | A63B 43/002 473/594 |
| 2011/0111896 | A1 * | 5/2011 | Frazier | A63B 39/06 473/604 |
| 2012/0199500 | A1 | 8/2012 | Trusso | |
| 2013/0020367 | A1 | 1/2013 | Buckley | |
| 2013/0260927 | A1 * | 10/2013 | Thurman | A63B 41/08 473/595 |
| 2013/0337948 | A1 * | 12/2013 | Smith | A63B 43/06 473/570 |
| 2014/0083875 | A1 | 3/2014 | Long | |
| 2017/0291075 | A1 | 10/2017 | McCafferty | |

* cited by examiner

100

1400

METHODS AND SYSTEMS ASSOCIATED WITH AN OBJECT FOR A GAME

CROSS-REFERENCE TO RELATED APPLICATIONS

This application claims a benefit of priority under 35 U.S.C. § 119 to Provisional Application No. 62/714,117 filed on Aug. 3, 2018, which is fully incorporated herein by reference in their entirety.

BACKGROUND INFORMATION

Field of the Disclosure

Examples of the present disclosure are related to systems and methods for an object for a game. Specific embodiments, disclosed an object, such as a ball, disk, etc., with a plurality of rows with slots, wherein the slots are configured to receive tokens.

Background

There are many games for children that require one participant throwing a ball, and others catching the ball for points. In various games, the thrower may decide if points will be awarded if the ball is caught directly, picked up after it hits the ground, etc. In conventional games, once a receiver accumulates a certain number of points, that receiver is determined the winner.

However, situations arise where it is difficult to keep an accurate accounting of the points each player has Accordingly, needs exist for a gaming system for an object configured to be thrown, wherein the object includes a plurality of slots configured to receive tokens.

SUMMARY

Embodiments of this disclosure are related to methods and systems associated with a game. The gaming system may be configured to allow a thrower to throw an object, and receivers to store tokens within the object. This may allow for players of the game to readily and efficiently tabulate the score of a game. Embodiments may include a throwing object and tokens.

The throwing object may be a ball, disk, or any other object that is configured to be thrown and/or caught. The object may include a plurality of rows of slots that are configured to each receive a token. Each of the rows of slots may be positioned along a longitudinal axis on the outer surface of the object, such that longer ends of the slots extend along the longer axis of the object. However, in other embodiments, the slots may extend around the lateral axis of the slots, such that the longer ends of the slots extend along a shorter axis of the object. In these embodiments, the rows of slots are radially aligned with each other around the circumference of the object.

In embodiments, the slots may have a depth that does not extend completely through the object, but allows tokens to be inserted and held within the slots. Responsive to inserting a token into the slot, a rim of the token may be visible.

The tokens may be small, flat, cylindrical object that are comprised of metal, plastics, or any other rigid material. The tokens may be configured to be inserted into the slots on the object. In embodiments, each player of the game may be given tokens of a different color, or number, or other unique identifier, wherein a rim of the token is visible to the players when the tokens are inserted into a slot. By allowing the tokens to be inserted into the slots and not having a single larger cavity to house all of the tokens, the weighting of the object may be substantially uniform even when tokens are present.

While in use, a thrower may throw the object to a group of players. Responsive to a first player catching the object, the first player may insert a first player token into a first row of slots corresponding to the first player. Responsive to a second player catching the object, the second player may insert a second player token into a second row of slots corresponding to the second player. A winner may be determined if each of the slots within a corresponding row has received a token, or if the number of slots within a corresponding row is above a predetermined winner threshold. For example, a winner may be determined if a corresponding row has more than three slots with embedded tokens.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
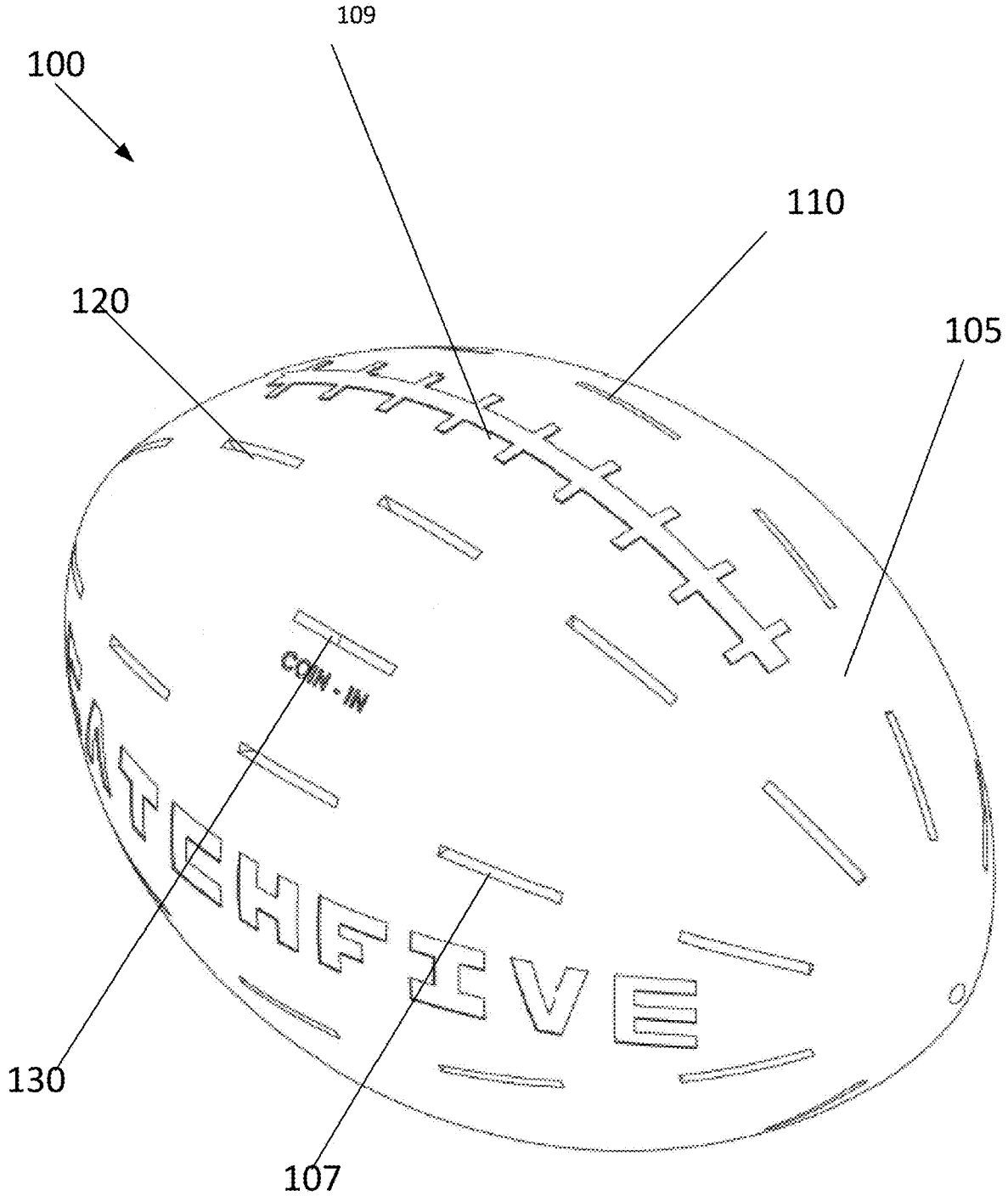
FIG. 1 depicts a perspective view of a gaming system, according to an embodiment.

Corresponding reference characters indicate corresponding components throughout several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent to one having ordinary skill in the art, that the specific detail need not be employed to practice the present embodiments. In other instances, well-known materials or methods have not been described in detail in order to avoid obscuring the present embodiments.

FIG. 1 depicts a perspective view of a gaming system 100, according to an embodiment. Gaming system 100 may include an object 105, laces 109, and a plurality of tokens (not shown).

Object 105 may be configured to be thrown by a player in a game to a plurality of receiving players in the game. Object 105 may be a football, bowling ball, baseball, disk, etc. or any other object configured to be thrown, moved, etc. from a first location to a second location. Object 105 may be comprised of leather with an inflatable bladder, plastics, rubber, foam, etc. Object 105 may have laces 109, plurality of slots 107 that are arranged in a plurality of rows 110, 120, and/or positioned as an independent slot 130.

Laces 109 may provide a grip for holding, hiking, and/or passing object 105. Laces 109 may be configured to extend from a first end of object 105 to a second end of object 105 in a direction of the longitudinal axis of object 105.

Slots 107 may be pockets, cavities, indentations extending into a body of object 105, wherein each slot 107 is configured to receive a token. Each of the slots 107 may have an exposed upper surface that is coplanar with an outer surface of object 100, and have a closed lower surface and closed sidewalls that are embedded within object 105. In embodiments, each slot 107 may have a length that is longer than the width of slot 107, and have a depth that is shorter than the diameter of a token or have a depth that is substantially the same diameter of the token. Accordingly, responsive to positioning a token within a slot 107, at least a portion of the token may protrude away from the surface of object 105 or have a rim that is co-planer with the surface of object 105. By allowing portions of the tokens to protrude away from the surface and shape of object 105, the shape and center of mass of object 105 may dynamically change based on the number and positioning of tokens within slots 107. This may cause the aerodynamics of object 105 to dynamically change. However, in embodiments where the slots 107 are configured to conform to a sizing of the tokens, the outer shape of object 100 may not change. This may cause the aerodynamics of object 105 to remain substantially the same.

Slots 107 may be arranged in a plurality of rows 110, 120, as well as be positioned askew from the plurality of rows 110, 120 as an independent slot 130. Each of the plurality of rows 110, 120 may extend from a first end of object 105 to a second end of object 105. The slots 107 in each row may be evenly and uniformly spaced apart. Slots 107 may extend in the same direction as laces 109 to better assist in the throwing and/or catching of object 105. However, in other embodiments, the rows of slots 107 may extend around the circumference of object 105.

In embodiments, each of the rows 110, 120 may correspond with a different player of the game. Responsive to a first player catching object 105, the first player may insert a token into a first slot on first row 110. Responsive to a second player catching object 105, the second player may insert a token into a first slot on second row 120. Based on the number of tokens inserted into corresponding slots, the players of the game may be able to quickly and efficiently determine a score of the current game.

Independent slot 130 may be positioned between rows of slots 107, wherein slot 130 may be the only slot 107 positioned on its axis between the first end and second end of object 105. In embodiments, independent slot 130 may be utilized by a thrower of object 105.

The tokens may be small, flat, cylindrical object that are comprised of metal, plastics, or any other rigid material. The tokens may be configured to be inserted into the slots 107 on the object 105. In embodiments, each player of the game may be given tokens of a different color, wherein a rim of the token is visible to the players when the tokens are inserted into the slots 107. By allowing the tokens to be inserted into the slots and not having a single larger cavity to house all of the tokens, the weighting of the object may be substantially uniform when all tokens are present, while allowing for a a dynamic center of mass of object 105 based on the positioning of the tokens.

Figure 2:
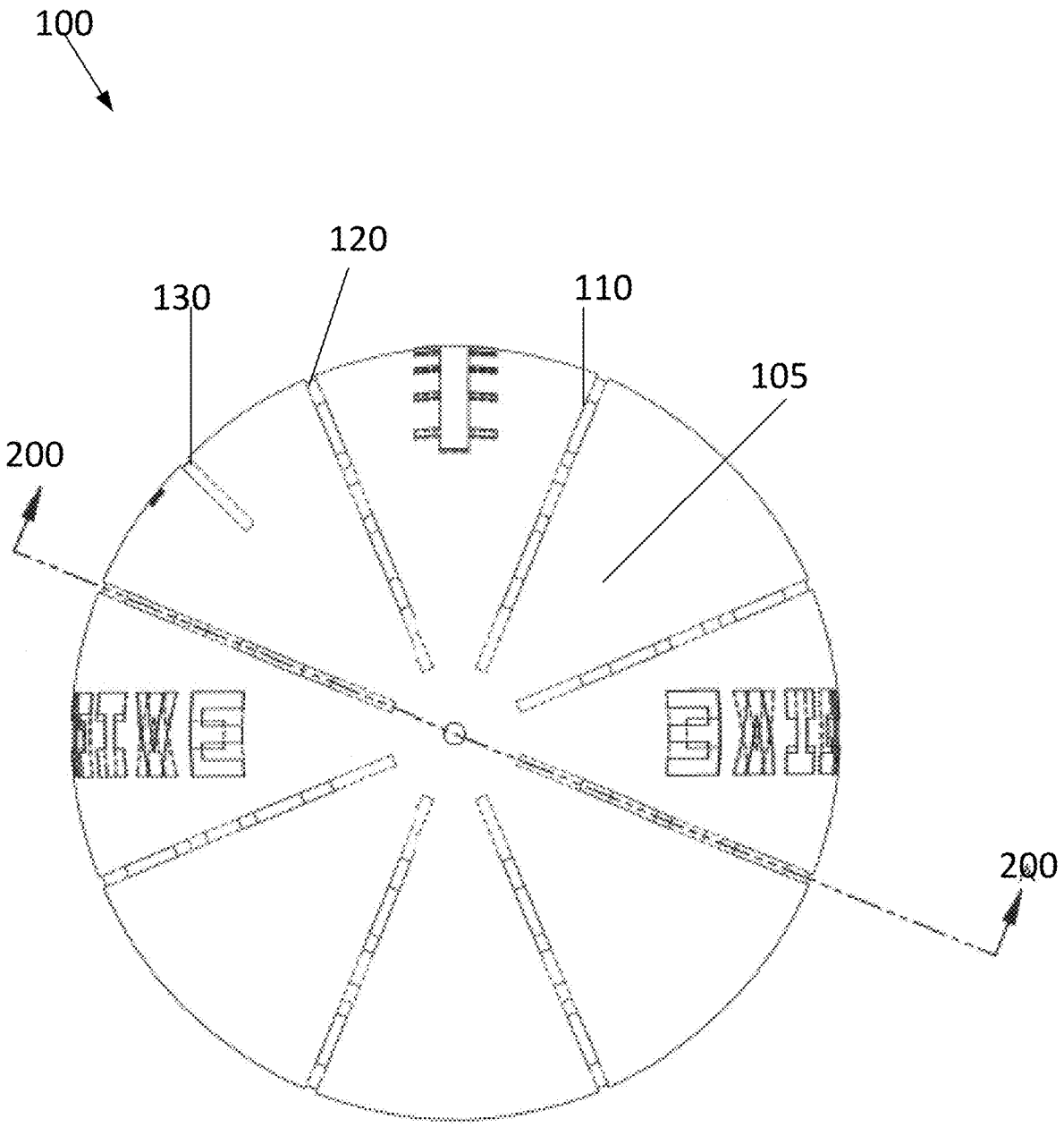
FIG. 2 depicts a top view of a gaming system, according to an embodiment.

FIG. 2 depicts a top view of gaming system 100, according to an embodiment. Elements depicted in FIG. 2 may be described above, and for the sake of brevity an additional elements of these elements is omitted.

As depicted in FIG. 2, object 105 may have a single independent slot 130 that is positioned between multiple rows. However, in other embodiments, more single independent slots may be positioned between rows of slots.

Figure 3:
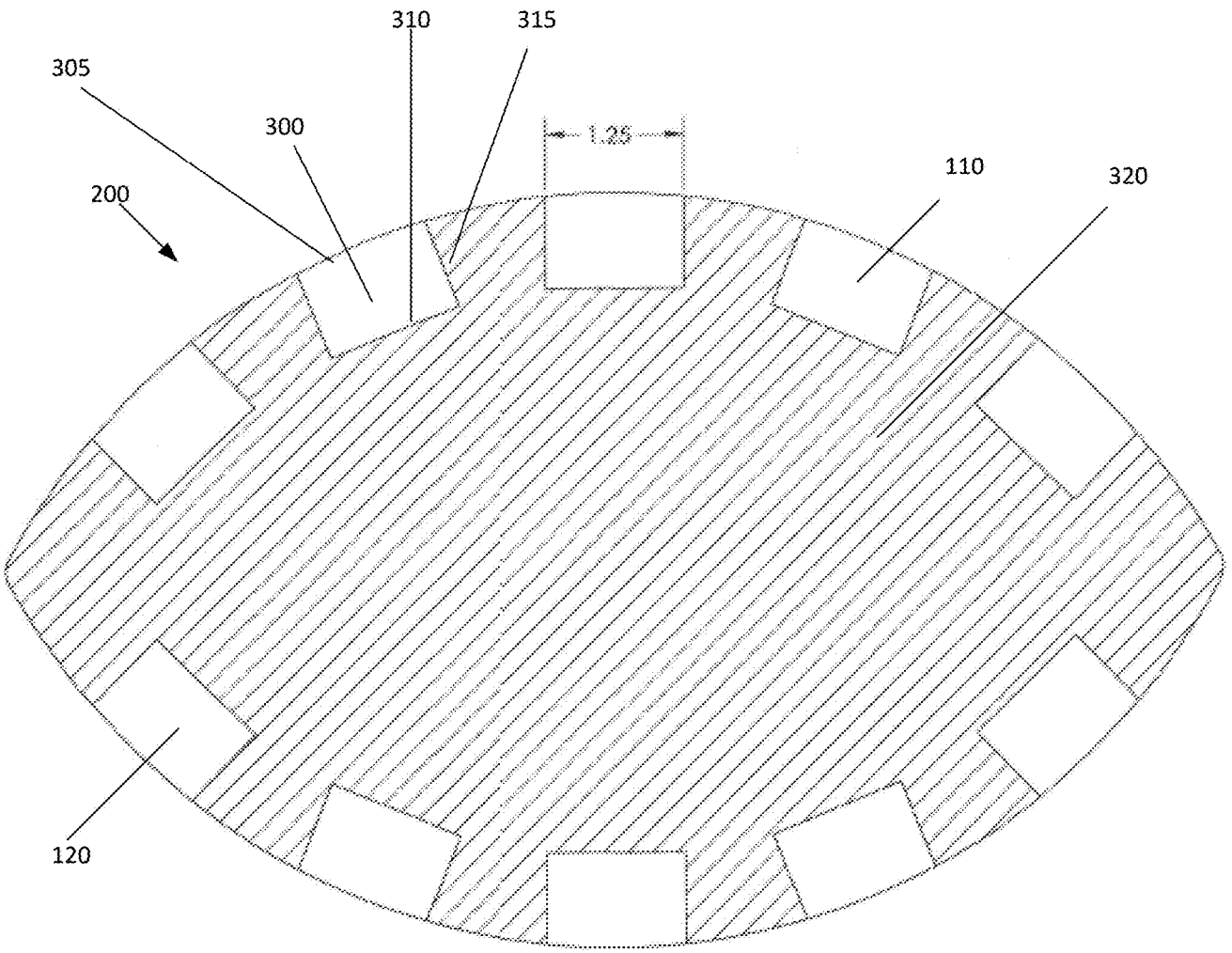
FIG. 3 depicts a cross sectional view of a gaming system, according to an embodiment.

FIG. 3 depicts a cross sectional view 200 of gaming system 100, according to an embodiment. Elements depicted in FIG. 3 may be described above, and for the sake of brevity an additional elements of these elements is omitted.

As depicted in FIG. 3, each of the slots 300 may include an upper surface 305, lower surface 310, and sidewalls 315.

The upper surface 305 of each slot 300 may be aligned with the curvature of the outer surface of object 105. The lower surface 310 of each slot may be embedded within object 105, without going through or crossing a central axis of object 105. This may allow object 105 to be a substantially rigid ball that has equal weighting. Sidewalls 310 may extend in a parallel fashion from upper surface 305 to lower surface 310 to create a hollow cavity with planar sidewalls within object 105. In implementations, a token may be inserted into the hollow cavity.

Furthermore, in embodiments, object 105 may have an inflatable bladder 320. Bladder 320 may be configured to occupy a space between slots 300, such that there is not an accessible hollow cavity within object 105.

Figure 4:
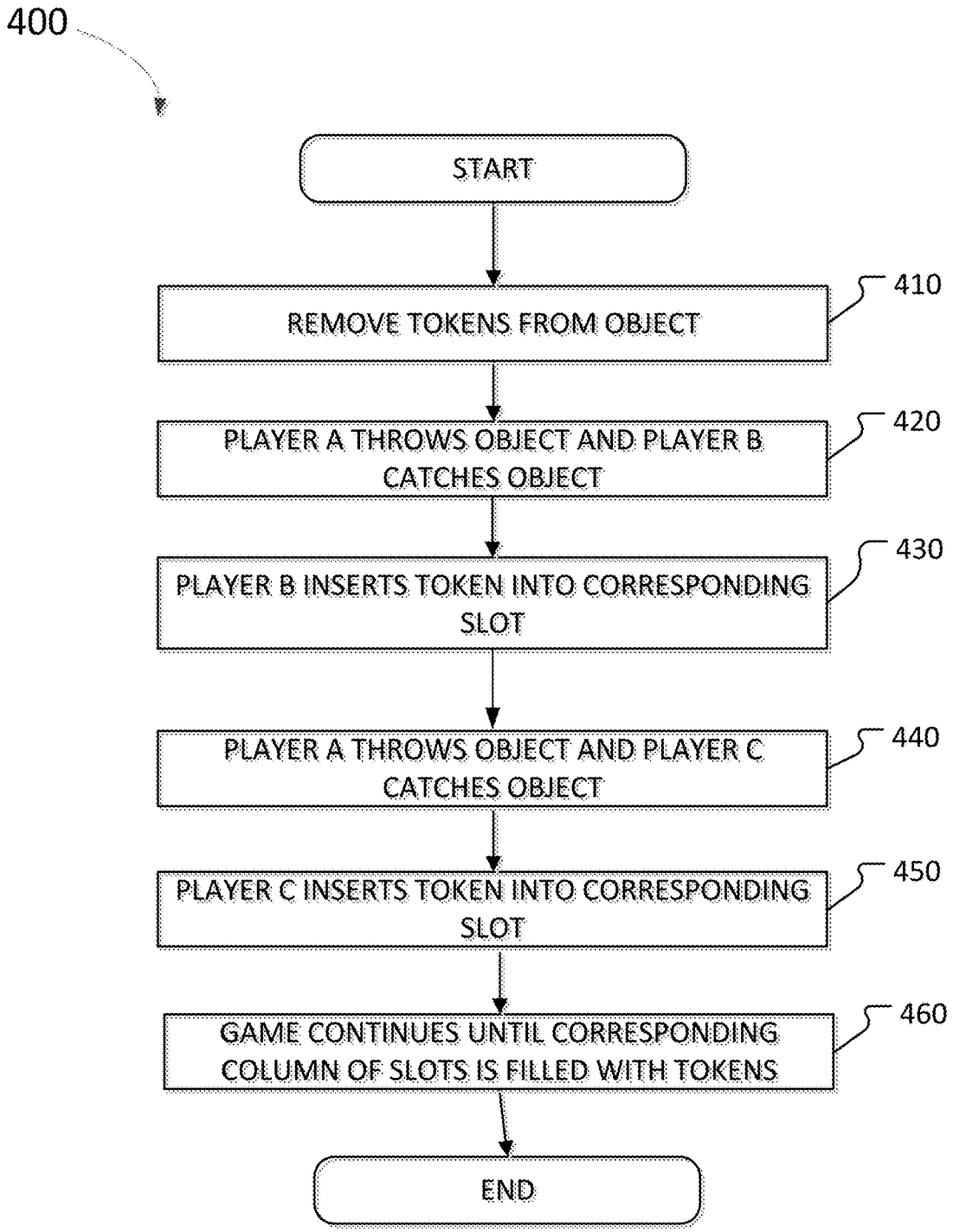
FIG. 4 illustrates a method for using a gaming system, according to an embodiment

FIG. 4 illustrates a method 400 for using a gaming system. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, all the tokens may be removed from the object at the start of the game. In alternative methods, certain players may insert tokens into the object before the start of the game as a way to set a handicap based on the relative skill levels of the players.

At operation 420, a first player may throw the object to the group of players, and a second player may catch the object.

At operation 430, the second player may insert a token of a first color, or number into a slot on a corresponding row of slots. When the token is positioned within the slot, a rim of the token may be visible. This may allow other players to efficiently and visually determine which rows of slots correspond with which player.

At operation 440, the first player may throw the object to the group of players, and a third player may catch the object.

At operation 450, the third player may insert a token of a second color, or number into a slot on a corresponding row of slots, wherein the row of slots corresponding to the third player is a different row of slots than that corresponding with the third player. When the token is positioned within the slot, a rim of the token may be visible. This may allow other players to visually determine which rows of slots correspond with which player.

At operation 460, the first player may continue to throw the object to the rest of the players until a single player has inserted a token into each of the slots within a corresponding row of slots. Furthermore, based on the numbers of tokens inserted into a single row, the center of mass of the object may be further offset from the center of the object. This may make the object more difficult to catch or throw.

Figure 5:
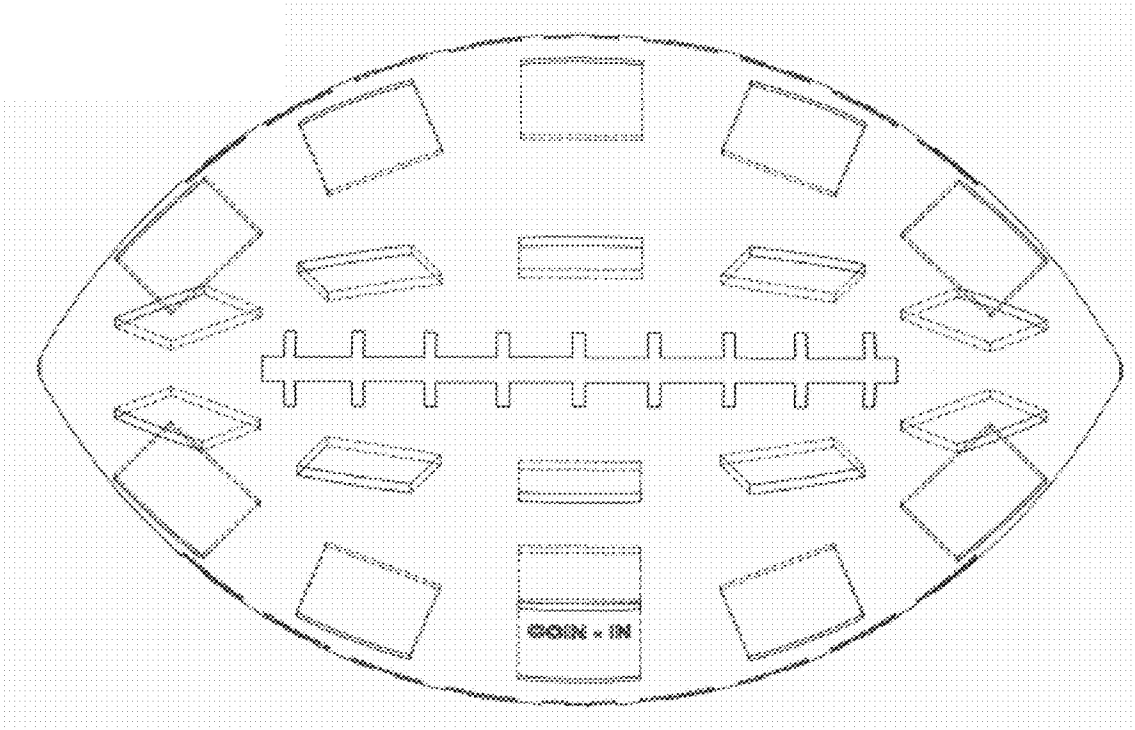
FIGS. 5-7 depict various views of a gaming system, according to an embodiment.
Figure 6:
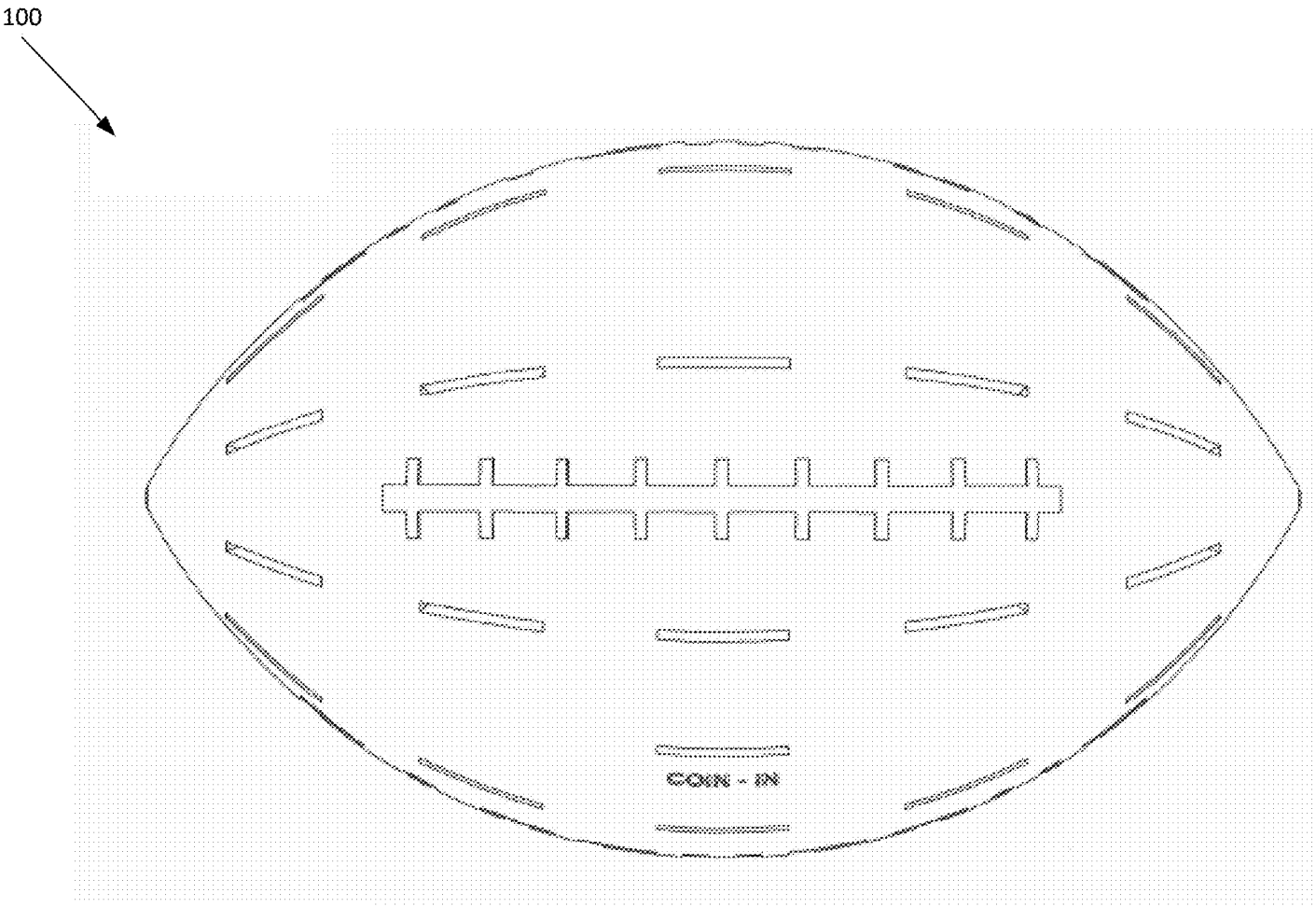
Figure 7:
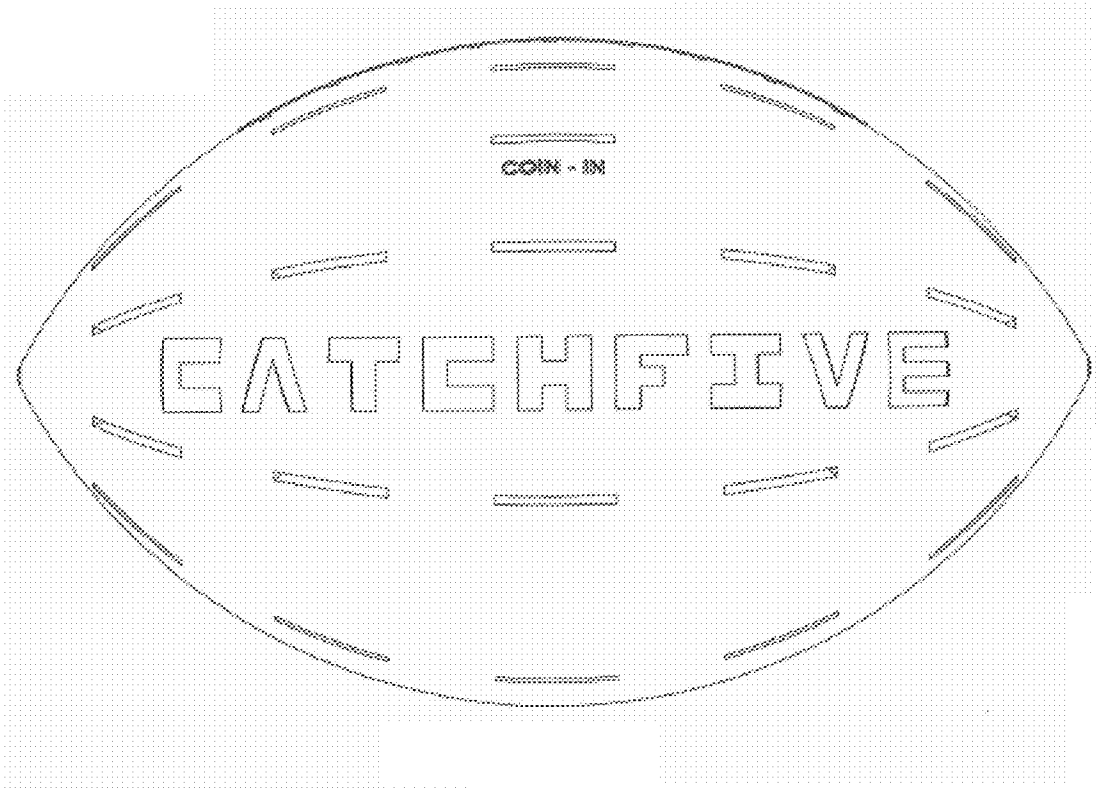
Figure 8:
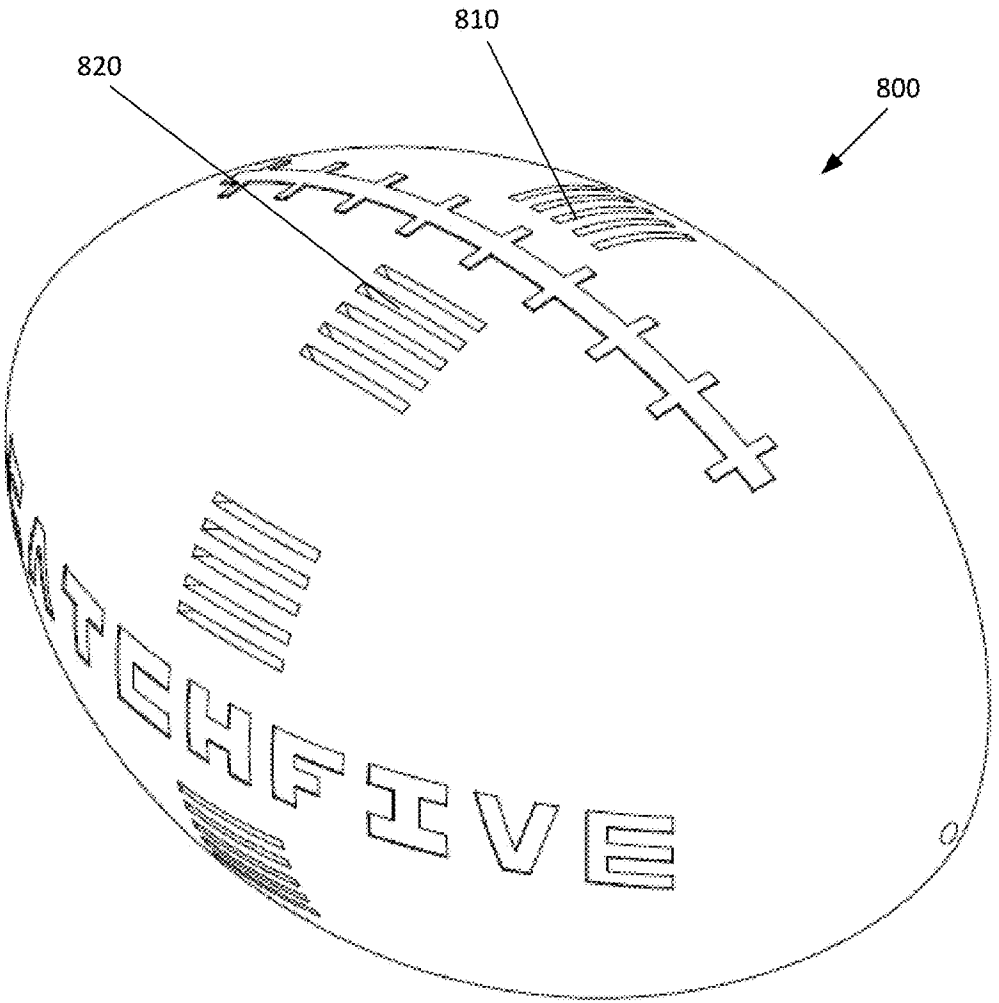
FIGS. 8-11 depict a gaming system, according to an embodiment.
Figure 9:
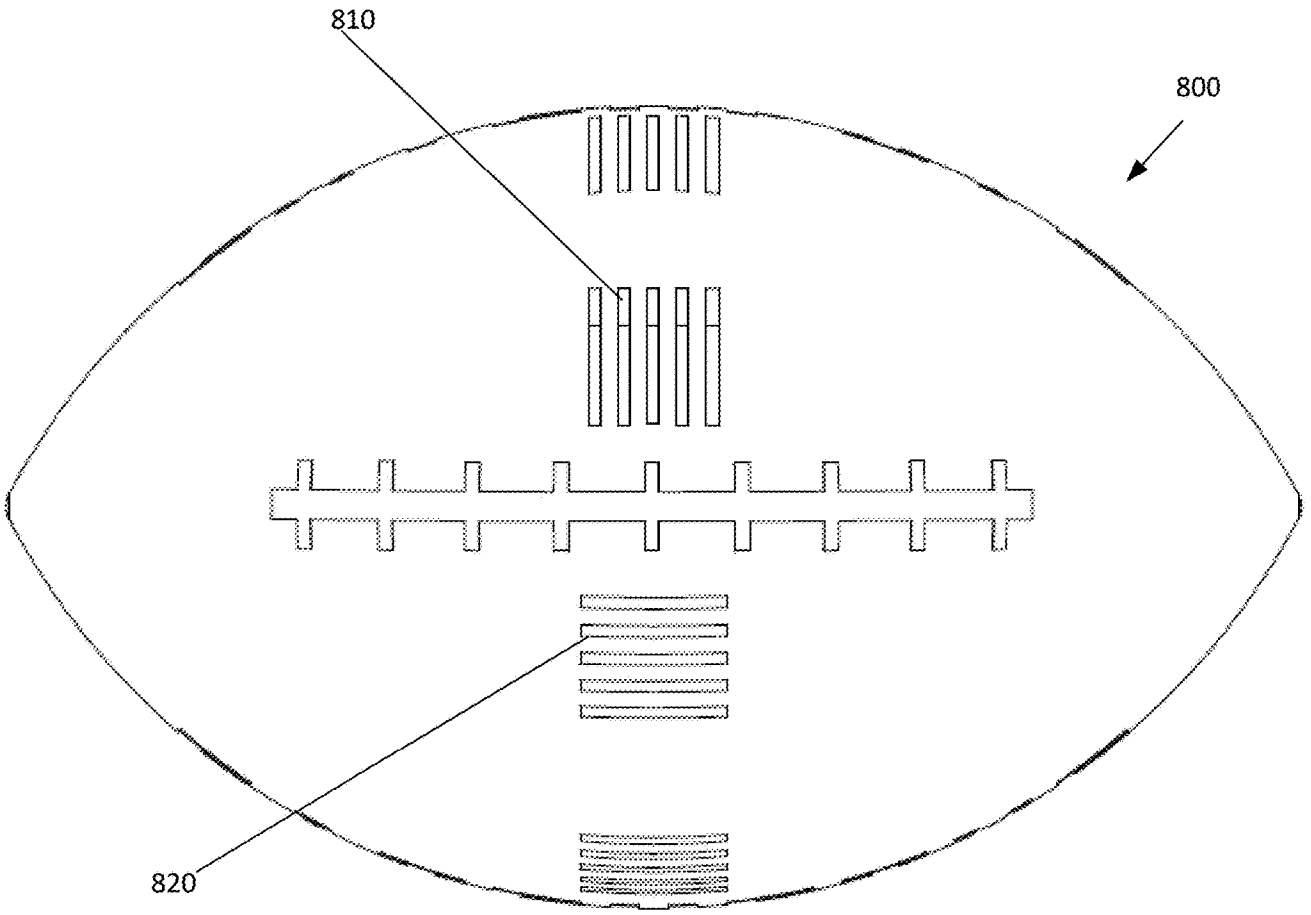
Figure 11:
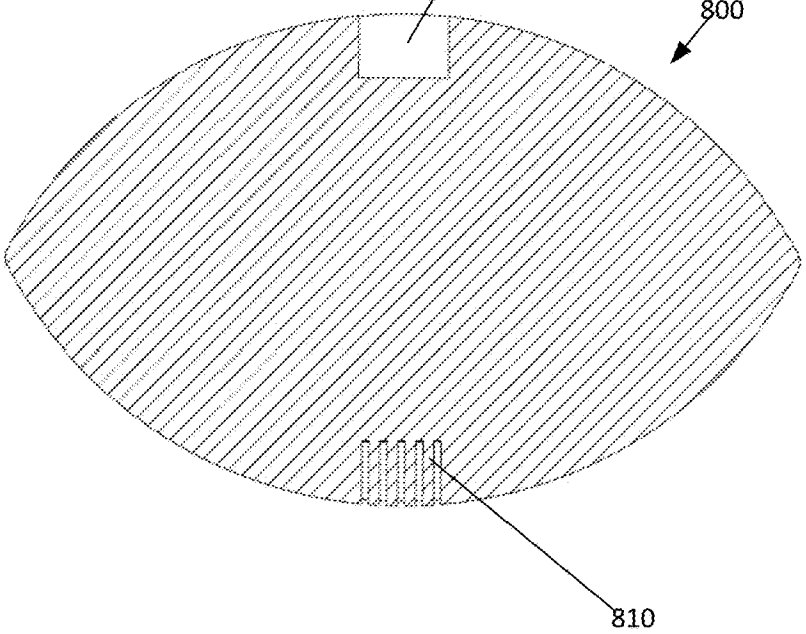
Figure 10:
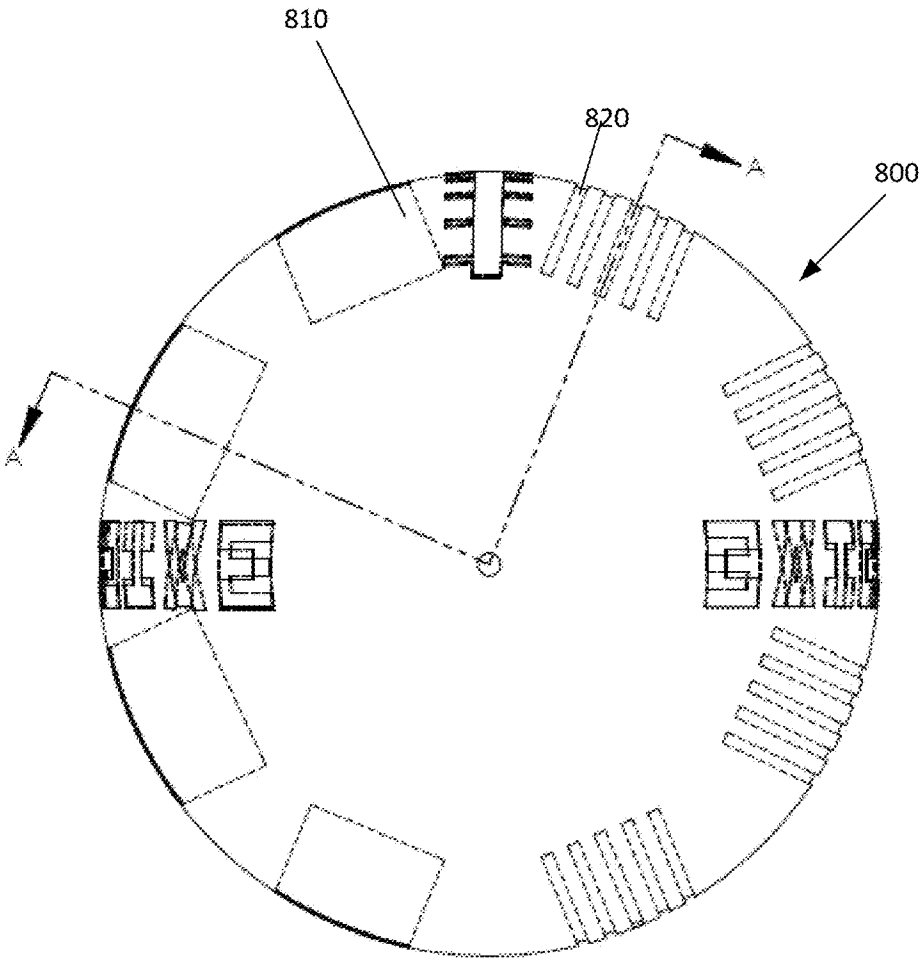

FIGS. 5-7 depict various views of a gaming system 100, according to an embodiment. As depicted in FIG. 5, object 105 may include eight rows of slots, where each row includes five slots, and one independent slot. FIGS. 6 and 7 depict an embodiment that includes eight rows of slots, where each row includes five slots and one independent slot.

FIGS. 8-11 depict gaming system 800, according to an embodiment. Elements depicted in FIGS. 8-11 may be described above, and for the sake of brevity a further description of these elements is omitted.

As depicted in FIGS. 8-11, gaming system 800 may include a plurality of rows 810 and columns 820 of slots positioned around a circumference of gaming system 800. The rows 810 and columns 820 of slots may have equal number of slots, but the slots within rows 810 may be perpendicular to those within columns 820. In embodiments, rows 810 may be positioned on a first half of gaming system 800 on a first side of the balls laces, while columns 820 may be positioned on a second half of gaming system 800 on a second side of the laces.

Furthermore, the rows 810 and columns 820 of slots may be positioned around the largest circumference of the object. This may allow for easier rotation of the object while thrown, and allow the center of mass of the object to be more closely aligned to a longitudinal axis of the object.

Figure 12:
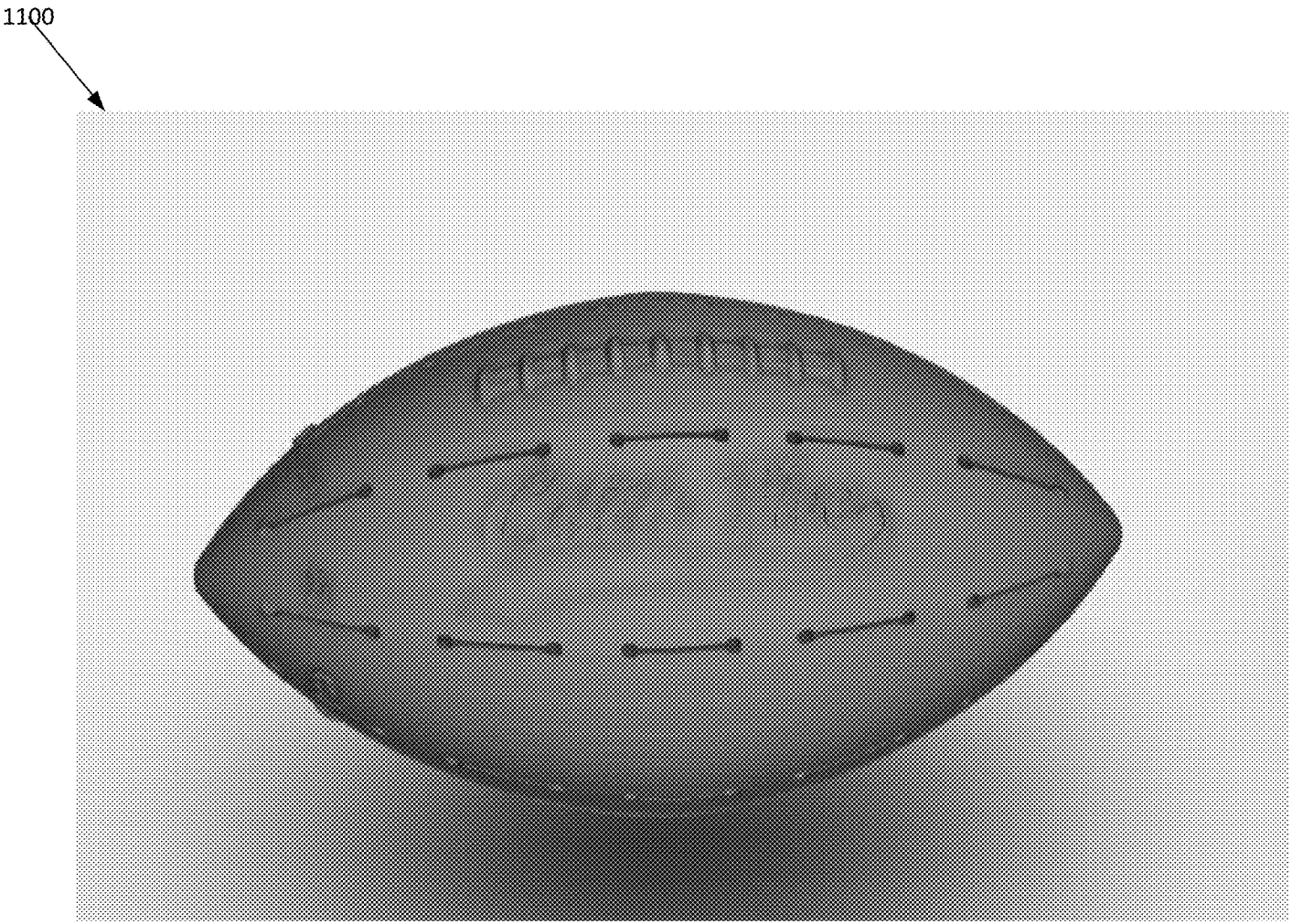
FIGS. 12-13 depict a gaming system, according to an embodiment.
Figure 13:
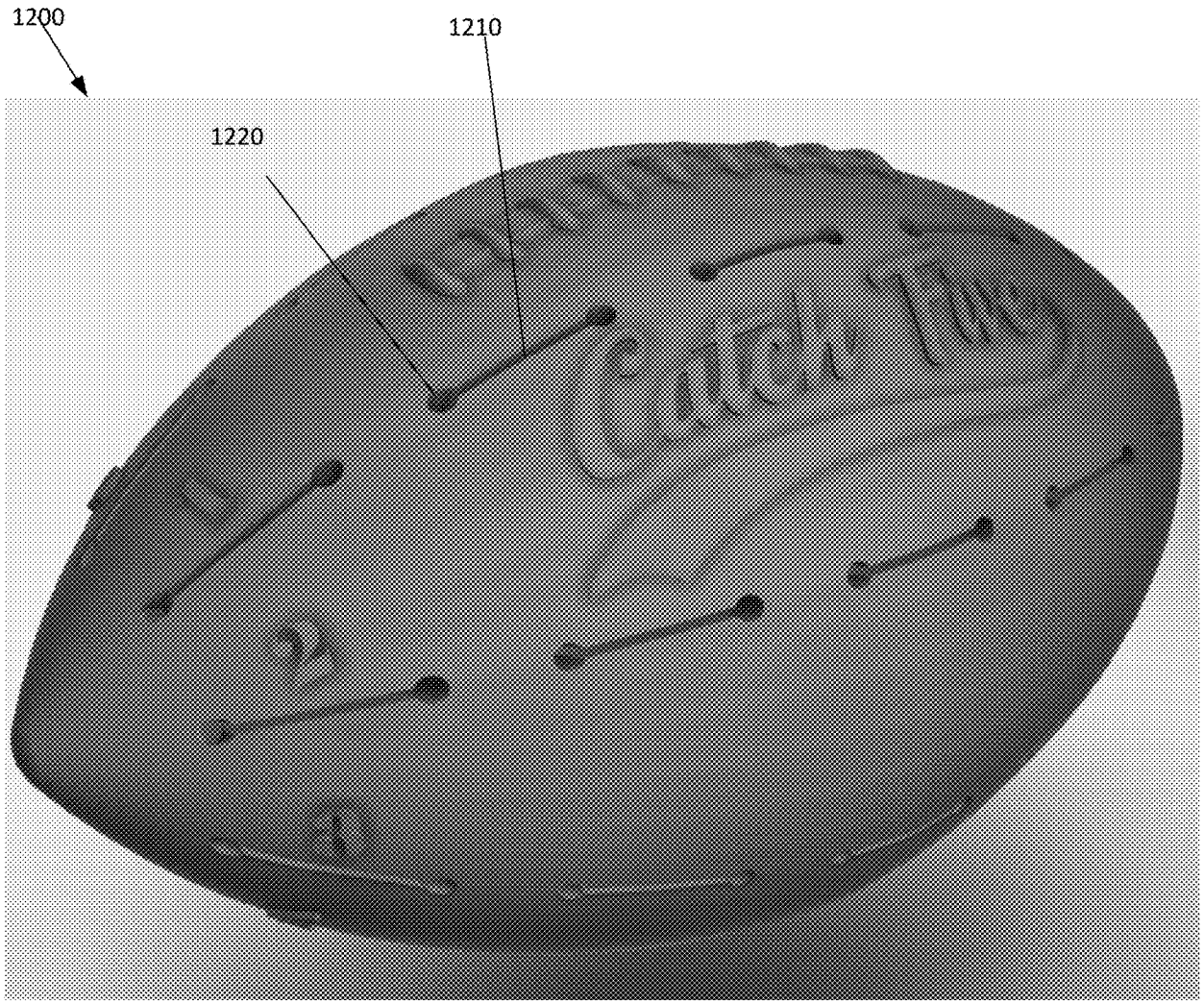
Figure 14:
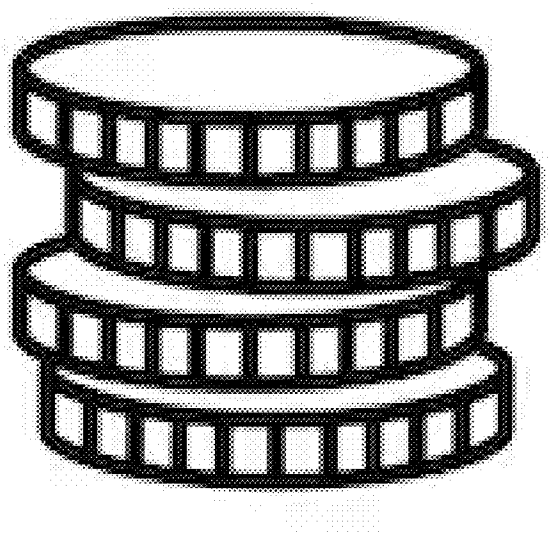
FIG. 14 depicts tokens utilized in a gaming system, according to an embodiment.

FIGS. 12 and 13 depict gaming system 1200, according to an embodiment. Elements depicted in FIGS. 12 and 13 may be described above, and for the sake of brevity a further description of these elements is omitted.

As depicted, slots 1210 may have ends 1220 that are larger in size then the body of slots 1210. As such, ends 1220 may be bulbous ends 1220 that are configured to allow a token to be more efficiently inserted and removed from slots 1210.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A gaming system comprising:

an object configured to be thrown, the object including a longitudinal axis with a first end and a second end, and a lateral axis, the longitudinal axis being longer than the lateral axis, wherein the object is a rigid object;

a plurality of rows comprising a plurality of slots, wherein each of the slots extends from an outer surface of the object towards a central axis of the object, each of the slots having a length and a width, the length of each slot extending along the longitudinal axis of the object and the width extending along the lateral axis of the object, the length of each of the slots being longer than the width, each of the slots having an exposed upper surface, closed lower surface, and planar sidewalls that extend from the closed lower surface to the exposed upper surface, wherein the length of each of the slots in a corresponding row extend along a same plane along the longitudinal axis, wherein each of the plurality of slots are symmetrical in shape.

2. The gaming system of claim 1, wherein each of the plurality of rows with the plurality of slots extends linearly in a direction from a first end of the object to a second end of the object, wherein the first end of the object to the second end of the object extends along a longitudinal axis of an outer surface of the object.

3. The gaming system of claim 1, wherein each of the plurality of rows with the plurality of slots extends radially around a circumference of the object, wherein the circumference of the object extends along a lateral axis of an outer surface of the object.

4. The gaming system of claim 1, wherein each of the plurality of rows includes five slots, wherein each of the plurality of rows are evenly spaced from each other.

5. The gaming system of claim 4, wherein the plurality of rows includes eight rows.

6. The gaming system of claim 1, wherein the object is a football.

7. The gaming system of claim 1, further comprising:

a plurality of tokens that are configured to be inserted into the plurality of slots.

8. The gaming system of claim 7, wherein a depth of each of the plurality of slots corresponds with a circumference of the plurality of tokens.

9. The gaming system of claim 1, further comprising:

an independent slot positioned between two of the plurality of rows.

10. The gaming system of claim 9, wherein the independent slot is positioned on a lateral axis of the object.

11. The gaming system of claim 10, wherein the independent slot is a single slot positioned on a linear axis between a first end of the object and a second end of the object.

12. The gaming system of claim 1, wherein each of the plurality of slots includes bulbous ends.

* * * * *